US009739237B2

(12) United States Patent
Nagasaki et al.

(10) Patent No.: US 9,739,237 B2
(45) Date of Patent: Aug. 22, 2017

(54) EXHAUST GAS RECIRCULATION DEVICE

(71) Applicant: TOYOTA JIDOSHA KABUSHIKI KAISHA, Toyota-shi, Aichi-ken (JP)

(72) Inventors: Taketo Nagasaki, Nagakute (JP); Yoshihiro Miyaji, Toyota (JP); Masaki Makihara, Okazaki (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 14/714,585

(22) Filed: May 18, 2015

(65) Prior Publication Data

US 2015/0337771 A1 Nov. 26, 2015

(30) Foreign Application Priority Data

May 26, 2014 (JP) ..... 2014-108408

(51) Int. Cl.
*F02M 25/07* (2006.01)
*F02M 26/20* (2016.01)
(Continued)

(52) U.S. Cl.
CPC ..... *F02M 25/07* (2013.01); *F02M 26/20* (2016.02); *F02M 26/44* (2016.02); *F02M 26/15* (2016.02); *F02M 26/23* (2016.02)

(58) Field of Classification Search
CPC ..... F02D 41/0065; F02D 41/005; F02D 2041/0067; F02D 41/0072; F02D 41/0047; F02D 41/0077; F02D 2041/0075; F02M 26/05; F02M 26/06; F02M 35/10222; F02M 26/19; F02M 26/22; F02M 26/21;
(Continued)

(56) References Cited

U.S. PATENT DOCUMENTS 5,884,612 A * 3/1999 Takeyama ..... F01M 13/022 123/568.17
2008/0011279 A1* 1/2008 Matsumoto ..... F02B 31/06 123/568.11

FOREIGN PATENT DOCUMENTS

CN 202273776 U 6/2012
JP 51-147822 U1 12/1976
(Continued)

OTHER PUBLICATIONS

Partial Translation of Nov. 8, 2016 Office Action issued in Japanese Application No. 2014-108408.

*Primary Examiner* — Sizo Vilakazi
(74) *Attorney, Agent, or Firm* — Oliff PLC

(57) ABSTRACT

An exhaust gas recirculation device for an engine including a plurality of cylinders and intake branch passages is provided. The exhaust gas recirculation device includes an exhaust chamber and distribution passages for the respective cylinders. The exhaust chamber is connected to an exhaust passage of the engine, and exhaust gas from the exhaust passage is introduced into the exhaust chamber. The distribution passages connect the exhaust chamber to the intake branch passages for the respective cylinders so as to recirculate the exhaust gas back into the intake branch passages. The flow passage area of a first portion of each of the distribution passages is smaller than the flow passage area of a second portion of each of the distribution passages. The first portion is connected to the corresponding intake branch passage, and the second portion is connected to the exhaust chamber.

3 Claims, 4 Drawing Sheets

(51) Int. Cl.
*F02M 26/44* (2016.01)
*F02M 26/15* (2016.01)
*F02M 26/23* (2016.01)

(58) Field of Classification Search
CPC ..... F02M 26/09; F02M 26/64; F02M 26/16; F02M 26/20; F02M 26/44; F02M 25/07
USPC ..... 123/568.11–568.32
See application file for complete search history.

(56) References Cited

FOREIGN PATENT DOCUMENTS

| | | |
|---|---|---|
| JP | H06-167251 A | 6/1994 |
| JP | 2013-113214 A | 6/2013 |

* cited by examiner

EXHAUST GAS RECIRCULATION DEVICE

INCORPORATION BY REFERENCE

The disclosure of Japanese Patent Application No. 2014-108408 filed on May 26, 2014 including the specification, drawings and abstract is incorporated herein by reference in its entirety.

BACKGROUND OF THE INVENTION

1. Field of the Invention

The invention relates to an exhaust gas recirculation device that recirculates a portion of exhaust gas into the air to be supplied to cylinders of a multi-cylinder engine.

2. Description of Related Art

Such an exhaust gas recirculation device is described in, for example, Japanese Patent Application Publication No. 2013-113214 (JP 2013-113214 A). The exhaust gas recirculation device described in JP 2013-113214 A includes an exhaust chamber and recirculated exhaust gas distribution passages for respective cylinders. The exhaust gas from an exhaust passage is introduced into the exhaust chamber. The recirculated exhaust gas distribution passages connect the exhaust chamber to branch pipes of an intake manifold, which are connected to the respective cylinders. The exhaust gas introduced into the exhaust chamber from the exhaust passage is distributed through the recirculated exhaust gas distribution passages to the branch pipes connected to the respective cylinders.

SUMMARY OF THE INVENTION

In the conventional exhaust gas recirculation device described above, the flow passage area of each recirculated exhaust gas distribution passage is constant over the entire length thereof. That is, in each recirculated exhaust gas distribution passage, the flow passage area of an inlet portion (a portion of the recirculated exhaust gas distribution passage, which is connected to the exhaust chamber) and an outlet portion (a portion of the recirculated exhaust gas distribution passage, which is connected to the branch pipe) are equal to each other. In this case, when the flow passage area of the inlet portion of the recirculated exhaust gas distribution passage is increased due to, for example, design requirements, the flow passage area of the outlet portion thereof is also increased.

Due to the intermittent inflow of intake air into each cylinder caused by opening and closing of an intake valve, pressure pulsation occurs in the branch pipe. In case where the flow passage area of the outlet portion of each recirculated exhaust gas distribution passage is large, when the flow rate of the recirculated exhaust gas introduced from the exhaust chamber is low, a portion of the air that flows through the branch pipe may flow backward to enter the exhaust chamber through the recirculated exhaust gas distribution passage due to a temporary pressure increase caused by the pulsation. When such a backflow of the air occurs, the concentration of the burned gas in the exhaust chamber becomes non-uniform. As a result, the concentration of the burned gas in the intake air to be introduced into combustion chambers of the cylinders, that is, the exhaust gas recirculation (EGR) ratio, varies among the cylinders. This may cause unstable combustion.

The invention provides an exhaust gas recirculation device configured to reduce the occurrence of a backflow of the air into an exhaust chamber.

An aspect of the invention relates to an exhaust gas recirculation device for an engine including a plurality of cylinders and intake branch passages configured to supply air to the cylinders respectively. The exhaust gas recirculation device includes an exhaust chamber and distribution passages for the respective cylinders. The exhaust chamber is connected to an exhaust passage of the engine, and exhaust gas from the exhaust passage is introduced into the exhaust chamber. The distribution passages connect the exhaust chamber to the intake branch passages for the respective cylinders so as to recirculate the exhaust gas back into the intake branch passages. The flow passage area of a first portion of each of the distribution passages is smaller than the flow passage area of a second portion of each of the distribution passages. The first portion is connected to the corresponding intake branch passage, and the second portion is connected to the exhaust chamber.

According to the above aspect, the flow passage area of the first portion is smaller than that of the second portion. Thus, the flow velocity of the recirculated exhaust gas is higher when the recirculated exhaust gas passes through the outlet portion (the first portion connected to the corresponding intake branch passage) than when the recirculated exhaust gas passes through the inlet portion (the second portion connected to the exhaust chamber). As a result, the air is less likely to flow back from the intake branch passage to enter the exhaust chamber than in a case where the flow passage area of the inlet portion and the flow passage area of the outlet portion are equal to each other.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
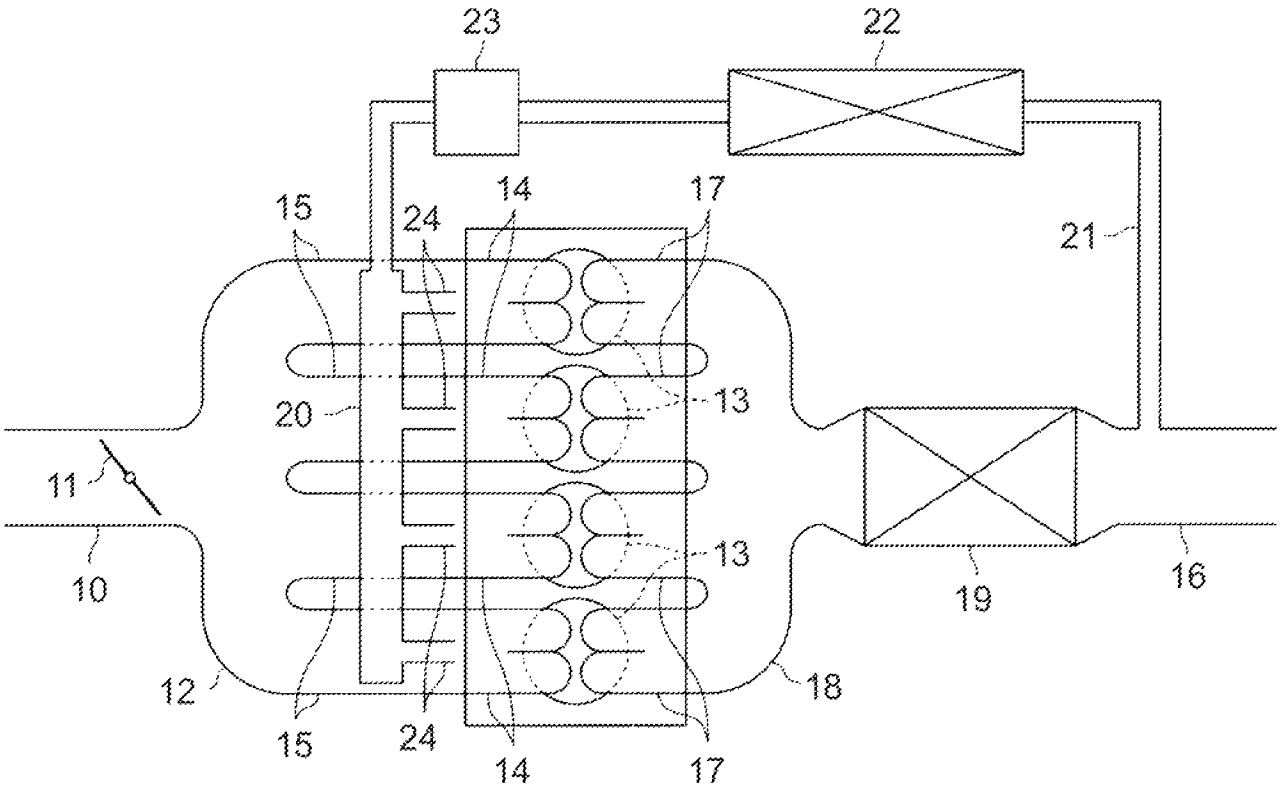
FIG. 1 is a view schematically illustrating the configuration of an exhaust gas recirculation device according to an embodiment of the invention.

Hereinafter, an exhaust gas recirculation device according to an embodiment of the invention will be described in detail with reference to FIG. 1 to FIG. 3. As illustrated in FIG. 1, an intake passage 10 of a multi-cylinder engine includes a throttle valve 11, an intake manifold 12 disposed downstream of the throttle valve 11, and intake ports 14 for the respective cylinders, which are connected to combustion chambers 13 of the respective cylinders. The intake passage 10 branches off, at the intake manifold 12, into branch pipes 15 for the respective cylinders, which are connected to the intake ports 14 of the respective cylinders. In the present embodiment, the branch pipes 15 and the intake ports 14 may function as intake branch passages for the respective cylinders in the invention, through which the air to be supplied to the cylinders of the multi-cylinder engine flows.

On the other hand, an exhaust passage 16 of the multi-cylinder engine includes exhaust ports 17 for the respective cylinders, which are connected to the combustion chambers 13 of the respective cylinders, and an exhaust manifold 18 that collects exhaust gases from the exhaust ports 17 for the respective cylinders. A catalytic converter 19 that cleans up the exhaust gas is disposed in the exhaust passage 16, at a position downstream of the exhaust manifold 18.

The exhaust gas recirculation device disposed in the multi-cylinder engine includes an exhaust chamber 20, an exhaust gas recirculation (EGR) pipe 21, and distribution passages 24 for the recirculated exhaust gas (hereinafter, referred to as "recirculated exhaust gas distribution passages 24"). The exhaust chamber 20 is integral with the intake manifold 12. The EGR pipe 21 connects a portion of the exhaust passage 16, which is located downstream of the catalytic converter 19, to the exhaust chamber 20. The EGR pipe 21 is provided with an exhaust gas recirculation (EGR) cooler 22 and an exhaust gas recirculation (EGR) valve 23. The EGR cooler 22 cools the exhaust gas that flows through the EGR pipe 21. The EGR valve 23 adjusts the amount of exhaust gas to be introduced into the exhaust chamber 20 from the EGR pipe 21. The exhaust chamber 20 is connected to the branch pipes 15 for the respective cylinders via the recirculated exhaust gas distribution passages 24 for the respective cylinders. The recirculated exhaust gas distribution passages 24 are integral with the intake manifold 12.

Figure 2:
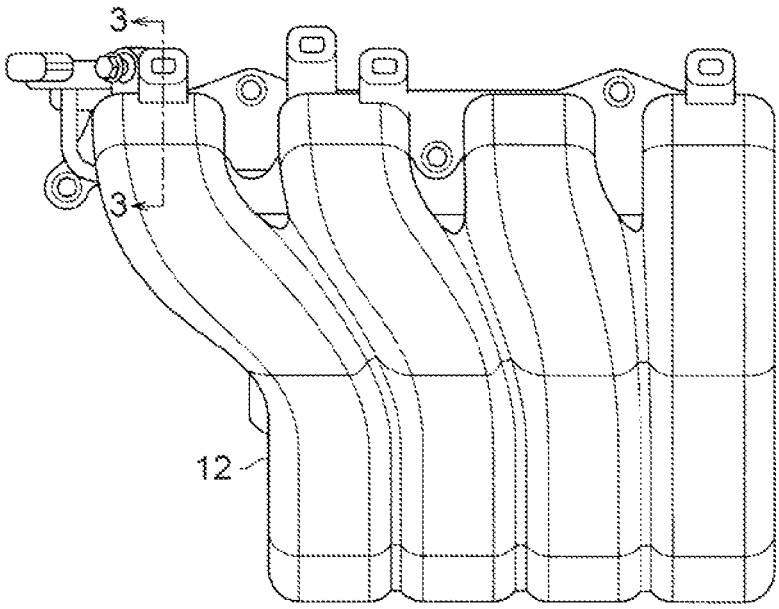
FIG. 2 is a top view of an intake manifold of a multi-cylinder engine to which the exhaust gas recirculation device in FIG. 1 is applied.
Figure 3:
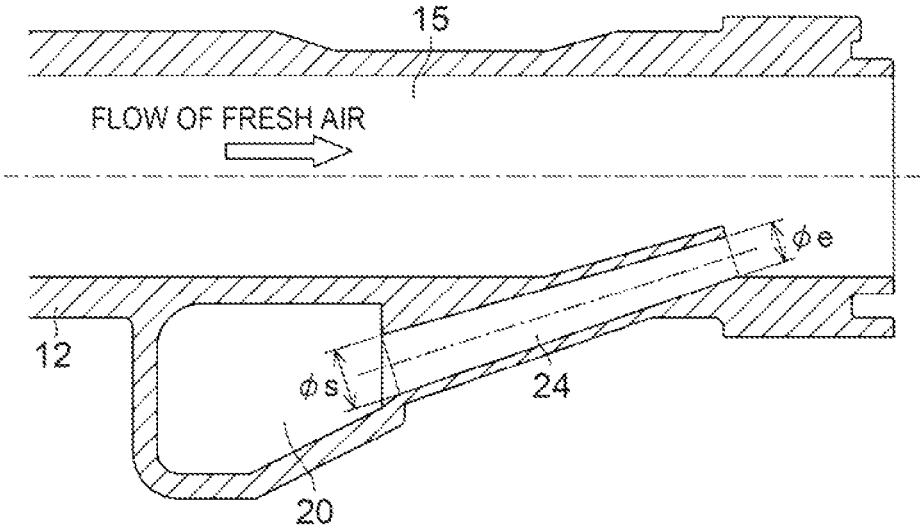
FIG. 3 is a sectional view of the intake manifold taken along the line 3-3 in FIG. 2.

FIG. 3 illustrates the sectional structure of the intake manifold 12 taken along the line 3-3 in a top view illustrated in FIG. 2. As illustrated in FIG. 3, the exhaust chamber 20 is formed at a portion of the intake manifold 12, which is located below the branch pipes 15 for the respective cylinders. The recirculated exhaust gas distribution passages 24 extend from the exhaust chamber 20 along the branch pipes 15. In the exhaust gas recirculation device according to the present embodiment, each recirculated exhaust gas distribution passage 24 is formed such that an end portion on the branch pipe 15 side protrudes into the branch pipe 15.

Each recirculated exhaust gas distribution passage 24 has a circular sectional shape, and is tapered such that the inner diameter thereof gradually decreases in a direction from the exhaust chamber 20 to the corresponding branch pipe 15. Specifically, the inner diameter of the recirculated exhaust gas distribution passage 24 gradually decreases from a value $\phi s$ at a portion (an inlet portion) thereof connected to the exhaust chamber 20 to a value $\phi e$ at a portion (an outlet portion) thereof connected to the branch pipe 15. Note that, the outlet portion may function as a first portion in the invention, and the inlet portion may function as a second portion in the invention. That is, the recirculated exhaust gas distribution passage 24 is formed such that the flow passage area thereof gradually decreases in a direction from the exhaust chamber 20 to the corresponding intake branch passage (the branch pipe 15). Thus, the flow passage area of the portion of the recirculated exhaust gas distribution passage 24, which is connected to the branch pipe 15, is smaller than the flow passage area of the portion of the recirculated exhaust gas distribution passage 24, which is connected to the exhaust chamber 20.

Next, description will be provided on the operational advantages of the shape of each recirculated exhaust gas distribution passage 24 of the exhaust gas recirculation device according to the present embodiment. In the recirculated exhaust gas distribution passage 24 formed as described above, the flow passage area of the outlet portion thereof is smaller than the flow passage area of the inlet portion thereof. Thus, the flow velocity of the recirculated exhaust gas is higher when the recirculated exhaust gas passes through the outlet portion than when the recirculated exhaust gas passes through the inlet portion. As a result, the air in the branch pipe 15 is less likely to flow into the recirculated exhaust gas distribution passage 24 than in a case where the flow passage area of the inlet portion and the flow passage area of the outlet portion are equal to each other. In addition, even when the air flows into the recirculated exhaust gas distribution passage 24, the pressure thereof decreases as the flow passage area increases. Thus, it is possible to reduce the occurrence of a backflow of the air from the branch pipe 15 into the exhaust chamber 20. As a result, it is possible to reduce the occurrence of non-uniform concentration of the burned gas in the exhaust chamber 20 due to a backflow of the air. Consequently, it is possible to reduce the occurrence of unstable combustion due to variations in the EGR ratio among the cylinders due to the non-uniform concentration of the burned gas.

The exhaust gas recirculation device according to the present embodiment produces the following advantageous effects (1) to (4). (1) In the present embodiment, the flow passage area of the portion (outlet portion) of the recirculated exhaust gas distribution passage 24, which is connected to the branch pipe 15, is smaller than the flow passage area of the portion (inlet portion) of the recirculated exhaust gas distribution passage 24, which is connected to the exhaust chamber 20. Thus, the flow velocity of the recirculated exhaust gas is higher when the recirculated exhaust gas passes through the outlet portion than when the recirculated exhaust gas passes through the inlet portion. This makes it possible to reduce the occurrence of a backflow of the air into the exhaust chamber 20. As a result, it is possible to reduce the occurrence of non-uniform concentration of the burned gas in the exhaust chamber 20 due to a backflow of the air. Consequently, it is possible to reduce the occurrence of unstable combustion due to variations in the EGR ratio among the cylinders due to the non-uniform concentration of the burned gas.

(2) The flow passage area of the inlet portion is set larger although the flow passage area of the outlet portion of the recirculated exhaust gas distribution passage 24 is set smaller. Thus, it is possible to limit an increase in pressure loss in the recirculated exhaust gas distribution passage 24 due to a decrease in the flow passage area of the outlet portion. Consequently, it is possible to limit a decrease in the amount of recirculated exhaust gas.

(3) When the sectional shape of the flow passage of the recirculated exhaust gas distribution passage 24 discontinuously varies, stagnation of the recirculated exhaust gas may occur at a portion where the sectional shape of the flow passage varies, leading to an increase in the flow resistance of the recirculated exhaust gas in the recirculated exhaust gas distribution passage 24. In this respect, in the present embodiment, the recirculated exhaust gas distribution passage 24 is tapered such that the inner diameter thereof gradually decreases in a direction from the exhaust chamber 20 to the corresponding branch pipe 15, and thus the sectional shape of the flow passage thereof continuously and gradually varies. Therefore, although the recirculated exhaust gas distribution passage 24 is formed such that the inlet portion and the outlet portion have different flow passage areas, an increase in the flow resistance due to a variation in the sectional shape of the flow passage thereof is limited.

(4) The flow passage area of the recirculated exhaust gas distribution passage 24 is varied in order to make the flow passage area of the outlet portion smaller than that of the inlet portion. The flow passage area is varied over the whole recirculated exhaust gas distribution passage 24 instead of being varied at only the outlet portion. As a result, a sharp decrease in the flow passage area at the outlet portion is avoided. Consequently, a turbulence of the recirculated exhaust gas to be introduced into the branch pipe 15 is less likely to be generated.

Figure 4A:
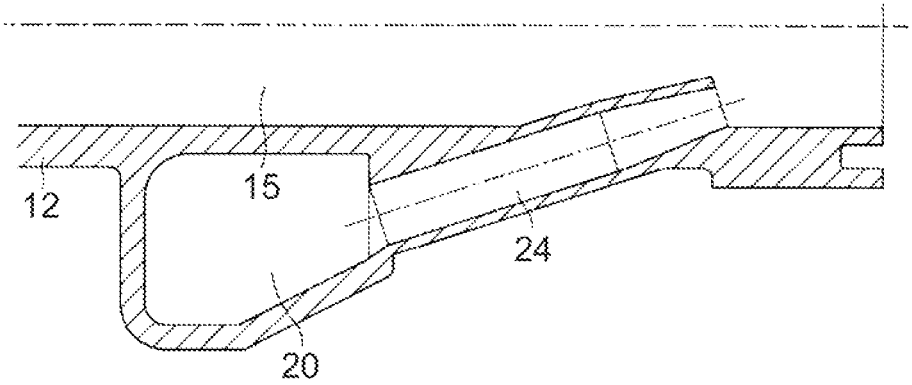
FIG. 4A is a sectional view of a distribution passage for the recirculated exhaust gas (hereinafter, referred to as "recirculated exhaust gas distribution passage"), which is partially tapered, and its surrounding structures in an exhaust gas recirculation device in a first modified example.
Figure 4B:
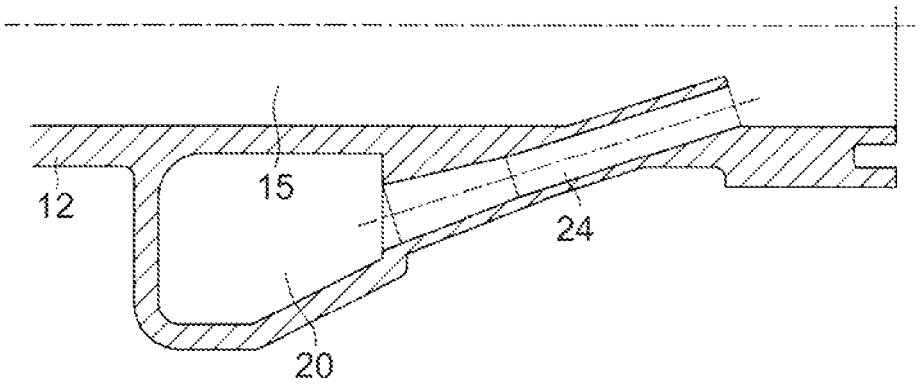
FIG. 4B is a sectional view of a recirculated exhaust gas distribution passage that is partially tapered and its surrounding structures in an exhaust gas recirculation device in a second modified example.
Figure 4C:
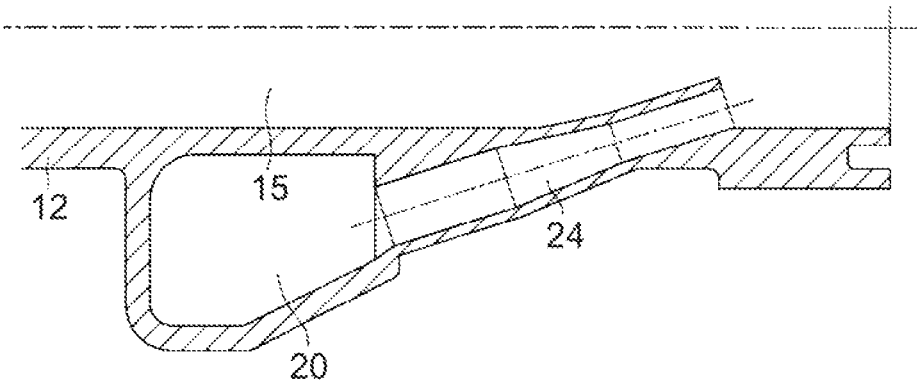
FIG. 4C is a sectional view of a recirculated exhaust gas distribution passage that is partially tapered and its surrounding structures in an exhaust gas recirculation device in a third modified example.

The foregoing embodiment may be modified as follows. As illustrated in FIG. 4A to FIG. 4C, only a portion of a recirculated exhaust gas distribution passage 24 is tapered such that the flow passage area of a portion of the recirculated exhaust gas distribution passage 24, which is connected to the branch pipe 15, is smaller than the flow passage area of a portion of the recirculated exhaust gas distribution passage 24, which is connected to the exhaust chamber 20. Even in these examples, it is possible to produce the advantageous effects similar to those in the foregoing embodiment. FIG. 4A illustrates a recirculated exhaust gas distribution passage 24 in a first modified example. In the first modified example, only a portion of the recirculated exhaust gas distribution passage 24, which is located on the branch pipe 15 side, is tapered such that the inner diameter of the portion gradually decreases in a direction to the branch pipe 15, whereas the other portion of the recirculated exhaust gas distribution passage 24 has a circular cylindrical shape having a constant inner diameter. FIG. 4B illustrates a recirculated exhaust gas distribution passage 24 in a second modified example. In the second modified example, only a portion of the recirculated exhaust gas distribution passage 24, which is located on the exhaust chamber 20 side, is tapered such that the inner diameter of the portion gradually decreases in a direction to the branch pipe 15, whereas the other portion of the recirculated exhaust gas distribution passage 24 has a circular cylindrical shape having a constant inner diameter. FIG. 4C illustrates a recirculated exhaust gas distribution passage 24 in a third modified example. In the third modified example, only an intermediate portion of the recirculated exhaust gas distribution passage 24 is tapered such that the inner diameter of the portion gradually decreases in a direction to the branch pipe 15, whereas each of the other portions of the recirculated exhaust gas distribution passage 24 has a circular cylindrical shape having a constant inner diameter.

Figure 5A:
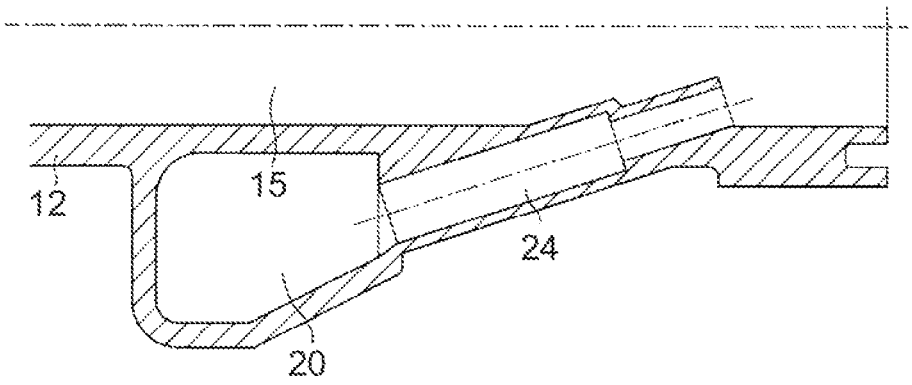
FIG. 5A is a sectional view of a recirculated exhaust gas distribution passage of which the flow passage area is varied in a stepwise manner and its surrounding structures in an exhaust gas recirculation device in a fourth modified example.
Figure 5B:
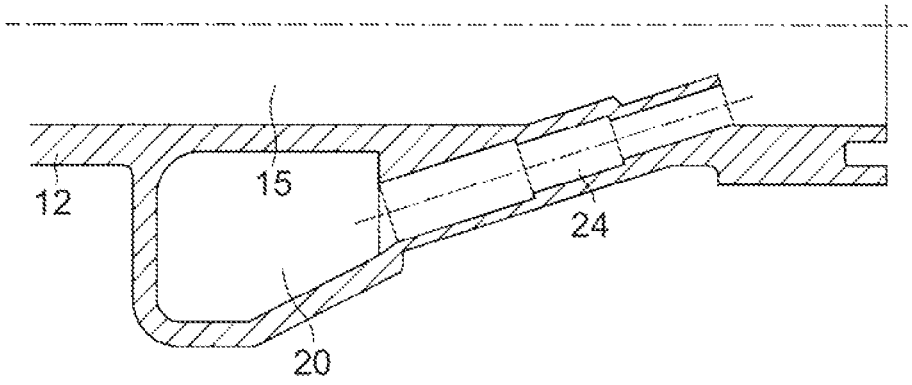
FIG. 5B is a sectional view of a recirculated exhaust gas distribution passage of which the flow passage area is varied in a stepwise manner and its surrounding structures in an exhaust gas recirculation device in a fifth modified example.

As illustrated in FIG. 5A and FIG. 5B, the flow passage area of a recirculated exhaust gas distribution passage 24 may be varied in a stepwise manner such that the flow passage area of a portion of the recirculated exhaust gas distribution passage 24, which is connected to the branch pipe 15, is smaller than the flow passage area of a portion of the recirculated exhaust gas distribution passage 24, which is connected to the exhaust chamber 20. Even in these examples, it is possible to produce the advantageous effects (1), (2) described above. FIG. 5A illustrates a recirculated exhaust gas distribution passage 24 in a fourth modified example. In the fourth modified example, the sectional area (the inner diameter) of the flow passage of the recirculated exhaust gas distribution passage 24 is varied once between the exhaust chamber 20 side and the branch pipe 15 side (i.e. there are two values of the sectional area (the inner diameter) of the flow passage of the recirculated exhaust gas distribution passage 24). FIG. 5B illustrates a recirculated exhaust gas distribution passage 24 in a fifth modified example. In the fifth modified example, the sectional area (the inner diameter) of the flow passage of the recirculated exhaust gas distribution passage 24 is varied twice between the exhaust chamber 20 side and the branch pipe 15 side (i.e. there are three values of the sectional area (the inner diameter) of the flow passage of the recirculated exhaust gas distribution passage 24).

In the foregoing embodiment, the exhaust chamber 20 and the recirculated exhaust gas distribution passages 24 are integral with the intake manifold 12. However, the exhaust chamber 20 and/or the recirculated exhaust gas distribution passages 24 may be provided separately from the intake manifold 12.

In the foregoing embodiment, each recirculated exhaust gas distribution passage 24 has a circular sectional shape. However, each recirculated exhaust gas distribution passage 24 may have any sectional shape other than a circular sectional shape. In the foregoing embodiment, the recirculated exhaust gas distribution passages 24 are disposed to connect the exhaust chamber 20 to the branch pipes 15 of the respective cylinders. However, the recirculated exhaust gas distribution passages 24 may be disposed to connect the exhaust chamber 20 to the intake ports 14 of the respective cylinders.

What is claimed is:

1. An exhaust gas recirculation device for an engine including a plurality of cylinders and intake branch passages configured to supply air to the cylinders respectively, the exhaust gas recirculation device comprising:

an exhaust chamber connected to an exhaust passage of the engine, exhaust gas from the exhaust passage being introduced into the exhaust chamber; and distribution passages for the respective cylinders, the distribution passages connecting the exhaust chamber to the intake branch passages for the respective cylinders so as to recirculate the exhaust gas back into the intake branch passages, a flow passage area of a first portion of each of the distribution passages being smaller than a flow passage area of a second portion of each of the distribution passages, the first portion being directly connected to the corresponding intake branch passage, and the second portion being directly connected to the exhaust chamber.

2. The exhaust gas recirculation device according to claim 1, wherein each of the distribution passages has a portion having a flow passage area that varies, the portion being a portion other than the first portion connected to the corresponding intake branch passage.

3. The exhaust gas recirculation device according to claim 1, wherein a flow passage area of each of the distribution passages gradually decreases in a direction from the exhaust chamber to the corresponding intake branch passage.

* * * * *